US012188659B2

(12) United States Patent
Flaherty et al.

(10) Patent No.: US 12,188,659 B2
(45) **Date of Patent: *Jan. 7, 2025**

(54) FLAME BURNER

(71) Applicant: Warming Trends, LLC, Englewood, CO (US)

(72) Inventors: Timothy Flaherty, Greenwood Village, CO (US); Kevin O'Connor, Parker, CO (US); Timothy Allons, Jr., Highlands Ranch, CO (US); Cory Nauman, Littleton, CO (US)

(73) Assignee: Warming Trends, LLC, Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/534,953

(22) Filed: Dec. 11, 2023

(65) Prior Publication Data

US 2024/0102658 A1 Mar. 28, 2024

Related U.S. Application Data

(63) Continuation of application No. 17/102,477, filed on Nov. 24, 2020, now Pat. No. 12,055,300.

(51) Int. Cl.
*F24B 1/18* (2006.01)
*F23D 14/48* (2006.01)

(52) U.S. Cl.
CPC ..... *F24B 1/1808* (2013.01); *F23D 14/48* (2013.01); *F23D 2900/14003* (2013.01); *F23D 2900/14641* (2013.01)

(58) Field of Classification Search
None
See application file for complete search history.

(56) References Cited

U.S. PATENT DOCUMENTS

| | | | |
|---|---|---|---|
| D31,429 | S | 8/1899 | Love |
| 804,496 | A | 11/1905 | Page |
| 1,342,617 | A | 6/1920 | Barber |
| 1,394,721 | A | 10/1921 | Festa |

(Continued)

FOREIGN PATENT DOCUMENTS

| | | | |
|---|---|---|---|
| CA | 2732462 | A1 | 7/2012 |
| DE | 10004159 | A1 | 8/2001 |

(Continued)

OTHER PUBLICATIONS

Montana Fire Pits; https://montanafirepits.com/best-brass-fire-pit-burner/; Retrieved Aug. 5, 2020 (7 pages).

(Continued)

*Primary Examiner* — David J Laux
(74) *Attorney, Agent, or Firm* — Bejin Bieneman PLC

(57) ABSTRACT

A decorative-flame burner includes a manifold elongated along an axis and a plurality of nipples supported by the manifold. A jet is supported by and protrudes outwardly from each nipple. Each nipple is elongated transverse to the axis from a first end of the nipple to a second end of the nipple. Each nipple has threads at the first end of the nipple and the manifold includes threaded holes spaced from each other along the axis and threadedly engaged with the threads on the first ends of the nipples.

22 Claims, 5 Drawing Sheets

(56) References Cited

U.S. PATENT DOCUMENTS

| | | | | |
|---|---|---|---|---|
| 1,539,420 | A * | 5/1925 | Kerr | F23D 14/04 431/286 |
| 1,590,195 | A * | 6/1926 | Kerr | F23D 14/10 239/565 |
| 1,781,784 | A | 11/1930 | Kerr | |
| 1,791,509 | A | 2/1931 | Morrow | |
| 1,818,783 | A | 8/1931 | Beam | |
| 1,820,493 | A | 8/1931 | Reagan | |
| 1,862,849 | A | 6/1932 | Frame | |
| 1,909,496 | A | 5/1933 | McKee | |
| 1,956,857 | A | 5/1934 | Cunningham | |
| 2,005,801 | A | 6/1935 | McKee | |
| 2,188,116 | A * | 1/1940 | Neale | F23D 14/045 239/592 |
| 2,345,247 | A * | 3/1944 | Erickson | F23D 14/04 431/350 |
| 2,547,276 | A | 4/1951 | Marsh et al. | |
| 2,559,527 | A | 7/1951 | Williams | |
| 2,569,514 | A | 10/1951 | Burklin | |
| 2,647,303 | A | 8/1953 | Ziherl | |
| 2,985,232 | A | 5/1961 | Greiner et al. | |
| D193,046 | S | 6/1962 | Sabo | |
| 3,038,064 | A | 6/1962 | Gieb | |
| 3,170,443 | A | 2/1965 | Herbert | |
| 3,270,967 | A | 9/1966 | Westerman et al. | |
| 3,279,705 | A | 10/1966 | Stiefel | |
| 3,291,190 | A | 12/1966 | Radley | |
| D209,256 | S | 11/1967 | Richardson | |
| 3,582,250 | A | 6/1971 | Chatfield | |
| 3,614,281 | A | 10/1971 | Ramey | |
| 3,760,790 | A | 9/1973 | Hodges et al. | |
| 4,061,133 | A | 12/1977 | Swain | |
| D258,076 | S | 1/1981 | Wiedenbeck | |
| 4,317,585 | A | 3/1982 | Boice | |
| 4,383,820 | A | 5/1983 | Camacho | |
| 4,686,957 | A | 8/1987 | Koziol | |
| 4,786,247 | A | 11/1988 | Bhattacharjee | |
| 4,875,464 | A | 10/1989 | Shimek et al. | |
| 4,951,650 | A | 8/1990 | Boyes et al. | |
| 5,000,162 | A | 3/1991 | Shimek et al. | |
| 5,042,845 | A | 8/1991 | Laboe | |
| 5,044,558 | A | 9/1991 | Young et al. | |
| 5,081,981 | A | 1/1992 | Beal | |
| 5,152,685 | A | 10/1992 | Coulon | |
| 5,421,321 | A | 6/1995 | Ward | |
| 5,474,102 | A | 12/1995 | Lopez | |
| 5,556,550 | A | 9/1996 | Fyffe | |
| 5,636,980 | A | 6/1997 | Young et al. | |
| 5,655,513 | A | 8/1997 | Whitfield | |
| 5,868,128 | A | 2/1999 | Omar | |
| 5,901,697 | A | 5/1999 | Oliver, Jr. et al. | |
| D412,738 | S | 8/1999 | Kuwabara | |
| D421,296 | S | 2/2000 | Kemp | |
| 6,044,836 | A | 4/2000 | Olivier, Jr. et al. | |
| 6,227,843 | B1 | 5/2001 | Pederson et al. | |
| 6,269,809 | B1 | 8/2001 | Fleming | |
| 6,289,887 | B1 | 9/2001 | Oliver, Jr. et al. | |
| D470,721 | S | 2/2003 | Home | |
| D483,096 | S | 12/2003 | Gotoh | |
| 6,796,302 | B2 | 9/2004 | Butler | |
| 6,901,773 | B2 | 6/2005 | Lawrence et al. | |
| 6,945,774 | B2 | 9/2005 | Shoeb | |
| 7,047,963 | B2 | 5/2006 | Van Vleet | |
| D534,767 | S | 1/2007 | Tseng | |
| D544,753 | S | 6/2007 | Tseng | |
| D548,007 | S | 8/2007 | Chung | |
| D553,430 | S | 10/2007 | Williams | |
| D554,237 | S | 10/2007 | Lewis | |
| D567,339 | S | 4/2008 | Tiberghien | |
| 7,479,008 | B2 | 1/2009 | Thomas | |
| 7,566,220 | B1 | 7/2009 | Thompson | |
| D608,424 | S | 1/2010 | Katsuta | |
| D627,039 | S | 11/2010 | Yu | |
| 8,033,822 | B2 | 10/2011 | Junkins | |
| D648,008 | S | 11/2011 | Percoco | |
| D728,755 | S | 5/2015 | Nasu | |
| 9,125,516 | B2 | 9/2015 | Adkins | |
| 9,612,018 | B2 | 4/2017 | Bettinzoli | |
| D793,806 | S | 8/2017 | Moy | |
| 9,816,705 | B2 | 11/2017 | Martin et al. | |
| 10,571,117 | B1 * | 2/2020 | Stone | F23C 5/08 |
| 11,131,455 | B2 * | 9/2021 | Stone | F23D 14/02 |
| D971,675 | S * | 12/2022 | O'Connor | D7/407 |
| D971,676 | S * | 12/2022 | O'Connor | D7/407 |
| 12,055,300 | B2 * | 8/2024 | Flaherty | F23D 14/48 |
| 2003/0194671 | A1 | 10/2003 | Webb | |
| 2004/0069149 | A1 | 4/2004 | Wakefield | |
| 2005/0181321 | A1 | 8/2005 | Hart et al. | |
| 2006/0088794 | A1 | 4/2006 | Purcell | |
| 2007/0006528 | A1 | 1/2007 | Diebold et al. | |
| 2007/0128562 | A1 | 6/2007 | Thomas | |
| 2007/0207429 | A1 | 9/2007 | Barker | |
| 2007/0224560 | A1 | 9/2007 | Stainrod et al. | |
| 2008/0115777 | A1 | 5/2008 | Hsu | |
| 2008/0308645 | A1 | 12/2008 | Presley et al. | |
| 2010/0193608 | A1 * | 8/2010 | Liou | F23D 14/64 239/589 |
| 2012/0074687 | A1 | 3/2012 | Mitchell | |
| 2013/0071796 | A1 | 3/2013 | Cole | |
| 2014/0008455 | A1 | 1/2014 | Muff et al. | |
| 2015/0168015 | A1 * | 6/2015 | Marple | F24H 9/1881 126/153 |
| 2015/0354814 | A1 | 12/2015 | Cody | |
| 2016/0053580 | A1 | 2/2016 | Briggs | |
| 2020/0158330 | A1 * | 5/2020 | Stone | F23C 5/08 |

FOREIGN PATENT DOCUMENTS

| | | | |
|---|---|---|---|
| GB | 190923368 | A | 9/1910 |
| GB | 552876 | A | 4/1943 |
| GB | 1126776 | A | 9/1968 |
| KR | 20100024828 | A | 3/2010 |
| WO | 2002093076 | A1 | 11/2002 |

OTHER PUBLICATIONS

Bobe Perfect Flame; "Perfect Flame by Bobe Water and Fire," published 2017; https://static1.squarespace.com/static/559c077be4b00d04ee713a77/t/5a847e9f652deab3dec30982/1518632613714/Torrent+Brochure+2017.pdf; Retrieved Aug. 5, 2020 (2 pages).

https://web.archive.org/web/20111229122931/http://firepitoutfitter.com/productimages/warmingtrends/crossfire_close.gif, Dec. 2011 (Year: 2011).

https://web.archive.org/web/20131130022654/thhp://www.warmingtrends.com/crossfireburners.html, Nov. 2013 (Year: 2013).

"Chapter 3: Pipe Fittings," Pipe Drafting and Design, by Roy A. Parisher and Robert A. Rhea, 3rd ed., Elsevier/GPP, 2012, pp. 36-37. (Year: 2012).

Fulford, Dr. David; Biogas Stove Design a Short Course; Aug. 1996; used in MSc Course on "Renewable Energy and the Environment" at the University of Reading, UK for and Advanced Biomass Module.

http://fireflypatio.com/fire-pit-kits.html; Firefly Patio & Hearth; Jan. 26, 2018.

2013 Warming Trends Catalog; published Oct. 3, 2013; pp. 1-42.

2014 Warming Trends Catalogue; published May 1, 2014; pp. 1-39.

YouTube video screen capture: "Hottest Firepits in The Market," published Mar. 1, 2012.

YouTube video screen capture: "Hottest Firepits in The Market," published Feb. 8, 2012.

European Extended Search Report for related application No. EP21208328.1 mailed Apr. 28, 2022 (5 pages).

* cited by examiner

FLAME BURNER

CROSS-REFERENCE TO RELATED APPLICATIONS

This application is a continuation of, and claims priority to, U.S. patent application Ser. No. 17/102,477, filed on Nov. 24, 2020, which is hereby incorporated by reference in its entirety.

BACKGROUND

A decorative-flame burner generates a flame that is decorative for the purpose of viewing. As examples, the burner may be used in a fire pit, fireplace, flame and water feature, etc. During operation of the burner, the flame is visible and the burner may be exposed or may be covered, entirely or partly, by an aggregate substrate (e.g., rock, stone, glass, etc.), faux logs (e.g., ceramic, steel, etc.), water, etc.

In operation, it is desirable to generate a flame that is tall with a natural appearance similar to the appearance of flames of burning logs. Some burners generate short flames that are spaced from each other, thus having a non-natural appearance. These short flames may also be at least partly blue in color, which also deviates from the appearance of a natural fire. In addition, some burners are manufactured from materials that are aesthetically unappealing at initial installation and are subject to corrosion. One such example is black steel pipe.

Other materials may have the benefit of better aesthetic appeal at installation and are resistant to corrosion. However, burners made of such materials are more costly to produce due to higher material cost, higher design and engineering cost, and higher manufacturing costs. Accordingly, it is desirable to design a decorative-flame burner that maximizes the height and aesthetically pleasing appearance of the flame while reducing the cost to build by minimizing the amount of material used in manufacturing and assembly.

DETAILED DESCRIPTION

Introduction

Figure 1:
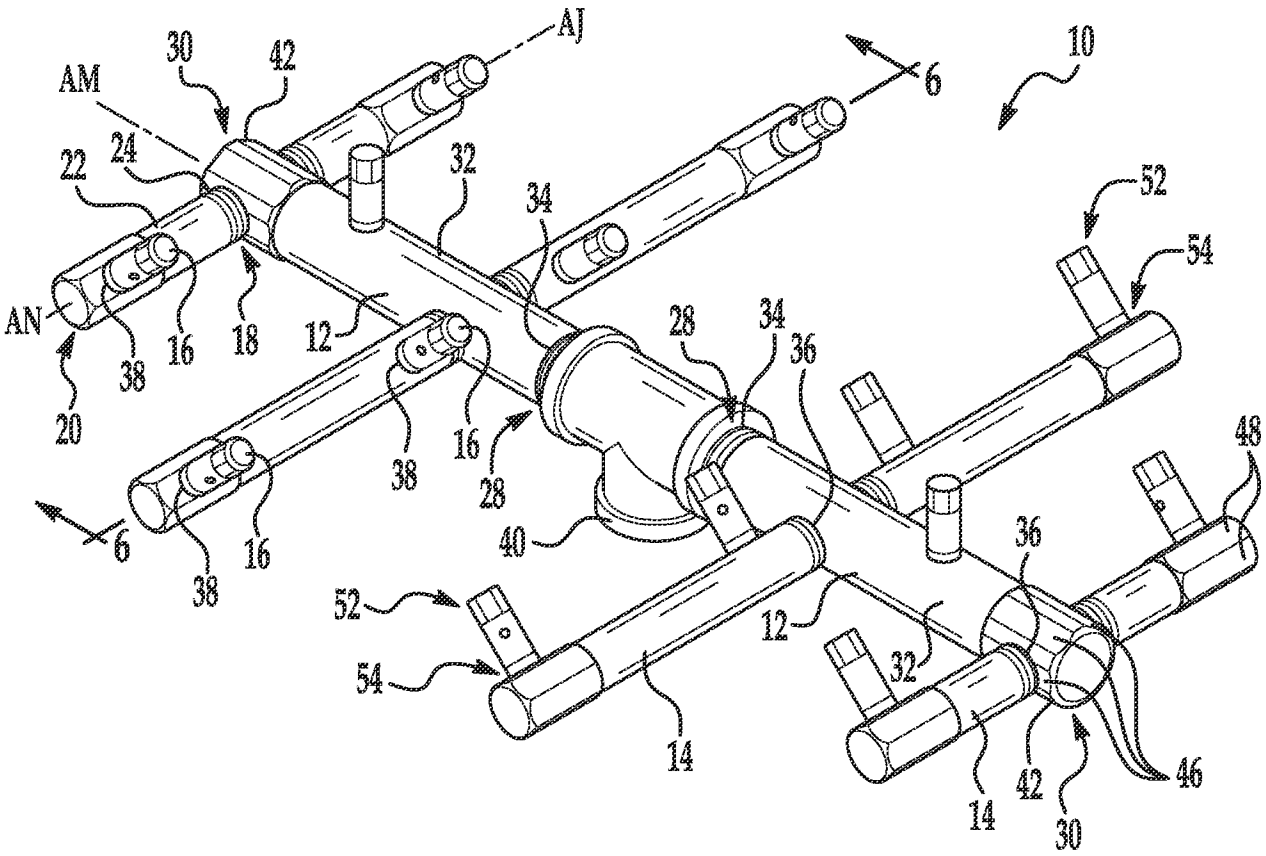
FIG. 1 is perspective view of one example of a decorative-flame burner.

With reference to the Figures, wherein like numerals indicate like parts throughout the several views, a burner 10 includes a manifold 12, a plurality of nipples 14, and a jet 16 supported by and protruding outwardly from each nipple 14. Each nipple 14 has a first end 18 that is open, a second end 20 that is closed, and a wall 22 extending from the first end 18 of the nipple 14 to the second end 20 of the nipple 14. The first end 18 of the nipple 14, the second end 20 of the nipple 14, and the wall 22 of the nipple 14 are unitary. Each nipple 14 has threads 24 at the first end 18 of the nipple 14. The manifold 12 includes threaded holes 36 spaced from each other along an axis AM of the manifold 12 and threadedly engaged with the threads 24 on the first ends 18 of the nipples 14.

The nipples 14 are directly connected to the manifold 12 by the threaded engagement of the threads 24 on the nipples 14 and the threaded holes 36 in the manifold 12, thus eliminating intermediate fittings between the nipples 14 and the manifold 12. This eliminates the cost of the fittings and also reduces the number of connected interfaces in the burner 10, i.e., providing a single connection between the nipple 14 and the manifold 12 (in contrast to three connections at each end of a T-shaped fitting). The unitary construction of the first end 18 of the nipple 14, the second end 20 of the nipple 14, and the wall 22 of the nipple 14 allows, in part, for assembly of the nipples 14 to the manifold 12 by direct connection since the nipple 14 may be rotated by a tool with all of the torque being delivered to the threads 24 without relative movement between the first end 18 and the second end 20. This also simplifies the assembly process to reduce the likelihood of marring of the nipple 14 during assembly of the nipple 14 to the manifold 12.

The burner 10 generates a flame that is decorative for the purpose of viewing. In other words, the burner 10 is a decorative-flame burner. As examples, the burner 10 may be used in a fire pit, fireplace, water feature, etc. In use, the flame is visible and the burner 10 may be exposed or may be concealed, entirely or partly, by an aggregate substrate (e.g., rock, stone, glass, etc.), faux logs (e.g., ceramic, steel, etc.), water, etc.

The manifold 12, nipples 14, and jets 16 each define gas passageways, respectively, in communication with each other to deliver fuel from the inlet line to the jet 16. The jet 16 releases the fuel to the atmosphere where the fuel is combusted as a decorative flame. The burner 10, including the manifold 12, nipples 14, and jets 16, may be designed to deliver and burn any suitable type of gaseous fuel, including natural gas and propane.

The burner 10 is configured to generate a decorative flame that is at least partly yellow and/or orange. As an example, the burner 10 may be configured to generate a flame that has a small blue portion at the jet with the remainder of the flame being yellow and/or orange to the tip of the flame. In such an example, the blue portion may be of a minimal size such that the blue portion is not viewable, e.g., may be covered by substrate. As another example, the burner 10 may be configured to generate a flame that is all yellow and/or orange, i.e., from the point of combustion at the jet 16 to a tip of the flame distal to the jet 16. Specifically, the burner 10 is configured to discharge the fuel from the jet 16 at an air-to-fuel ratio to generate a flame that is at least partly yellow and/or orange. The burner 10 is configured to burn a fuel-rich combustion mixture at an air-to-fuel to generate the yellow and/or orange color. Specifically, the fuel-rich combustion mixture generates the yellow and/or orange flame in contrast with a fuel-lean combustion mixture that generates a blue flame. As an example, a blue flame may be used in applications in which the flame is used solely for heat generation, e.g., for heating, cooking, etc., without concern for decorative appearance. The jet 16 may generate a Venturi effect to mix air with the fuel to feed an air-to-fuel ratio at the point of combustion to generate a flame that is yellow and/or orange. For natural gas and propane, for example, the burner 10 may be configured to burn at approximately 1000-1200° C. to generate the yellow and/or orange color of the flame.

The burner 10 is configured to generate a tall, dancing flame. This is generated, in part, by the flow rate of fuel to the jet 16 and the Venturi effect generated by the jet 16 to discharge the air-fuel combination at a high velocity. In addition, each jet 16 generates a flame and each flame from each jet 16 dances. In other words, the jets 16 are configured to discharge the air/fuel mixture such that the flame fluctuates in width and height during a stable fuel supply rate at an inlet coupling 40. The flames from the individual jets 16 intermingle and/or combine. In some examples, the flames combine together by swirling based on the aim of the jets 16 relative to each other. The flames from all of the jets 16, in combination, dance. The burner 10 described herein may operate, for example, at 60,000-450,000 BTU. For example, the burner 10 in FIG. 1 may operate at 140,000 BTU. The jets 16 shown in FIG. 1, for example, may each operate at 10,000 BTU.

Figure 9:
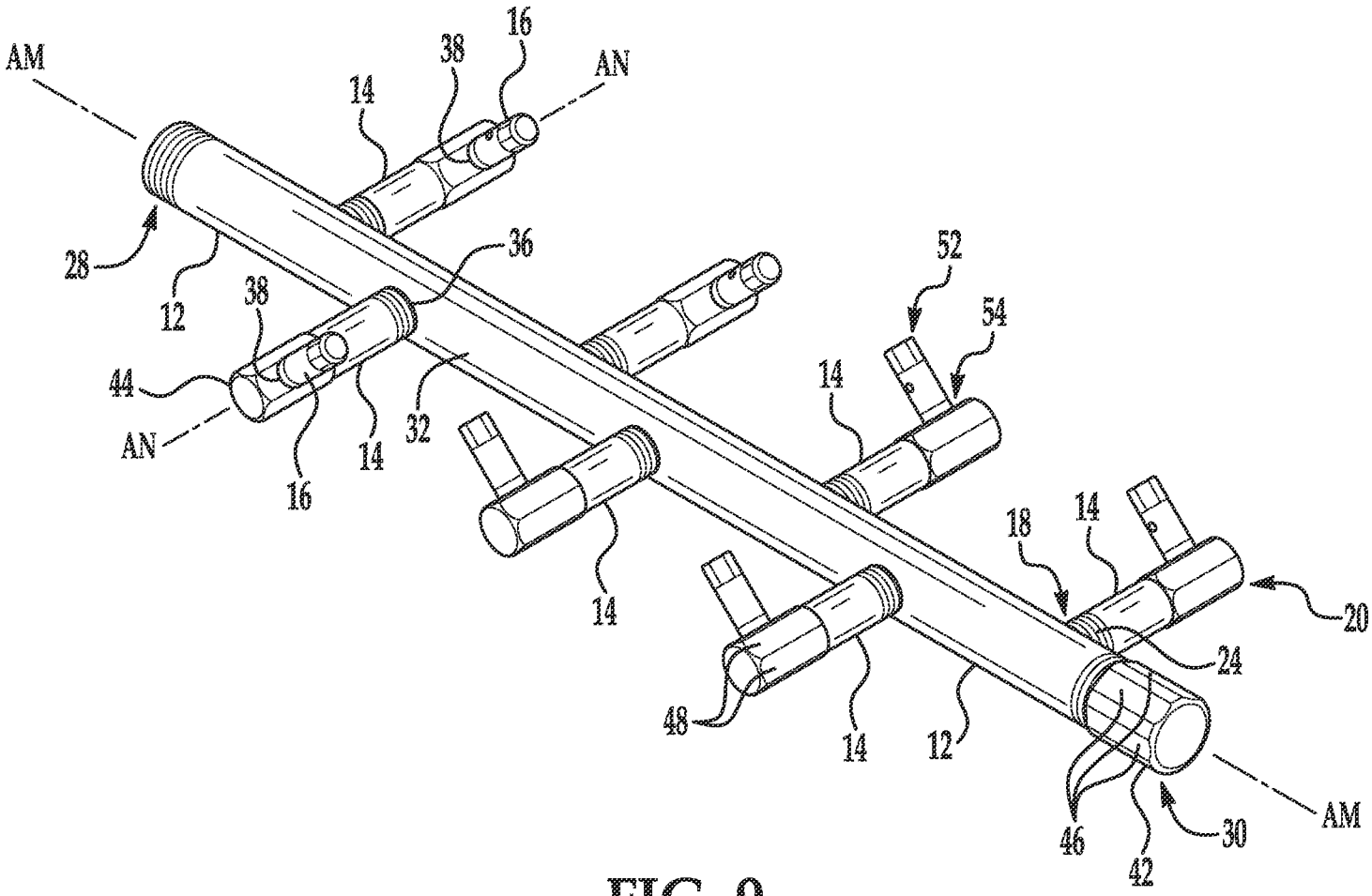
FIG. 9 is a perspective view of another example of the decorative-flame burner.

The manifold 12, nipples 14, and jets 16 may be arranged in any suitable shapes to position the jets 16 and aim the jets 16 to generate the tall, dancing flame. One example arrangement is shown in FIG. 1 and another example arrangement is shown in FIG. 9. In the example shown in FIG. 1, the burner 10 includes two manifolds 12, eight nipples 14, and 14 jets 16. In the example shown in FIG. 9, the burner 10 includes one manifold 12, seven nipples 14, and seven jets 16. In other examples, the burner 10 may include any suitable number of manifolds 12, nipples 14, and jets 16.

As described further below, the footprint of the burner 10 provides, at least in part, the generation of the tall, dancing flame. Specifically, the relative location of the jets 16, at least in part, generates the tall, dancing flame. As an example, the elongation of the manifolds 12 and nipples 14 along axes AM, AN, respectively, that are transverse to each other provides the footprint to locate the jets 16 for generation of the tall, dancing flame. The axes AM of the manifolds 12 may be perpendicular to the axes AN of the nipples 14, as described further below, to create the footprint of the burner 10 that provides, at least in part, the generation of the tall, dancing flame.

The burner 10 is brass. Specifically, the manifold 12, the nipples 14, and the jets 16 are brass. The brass is corrosion resistant, sustainable, and rust-proof.

The manifold 12, the nipples 14, and the jets 16 may be specially manufactured for the burner 10 disclosed herein. As set forth above, in the example shown in the Figures, the manifold 12, nipples 14, and jets 16 are formed by machining a brass bar, i.e., to include bores and the other features. Specifically, the manifold 12, nipples 14, and jets 16 may be designed and manufactured to have the size and shape to generate the tall, dancing flame having yellow and/or orange color, as described above. The designs shown in the Figures and the dimensions disclosed herein generate the tall, dancing flame having yellow and/or orange color.

Inlet Coupling

Figure 2:
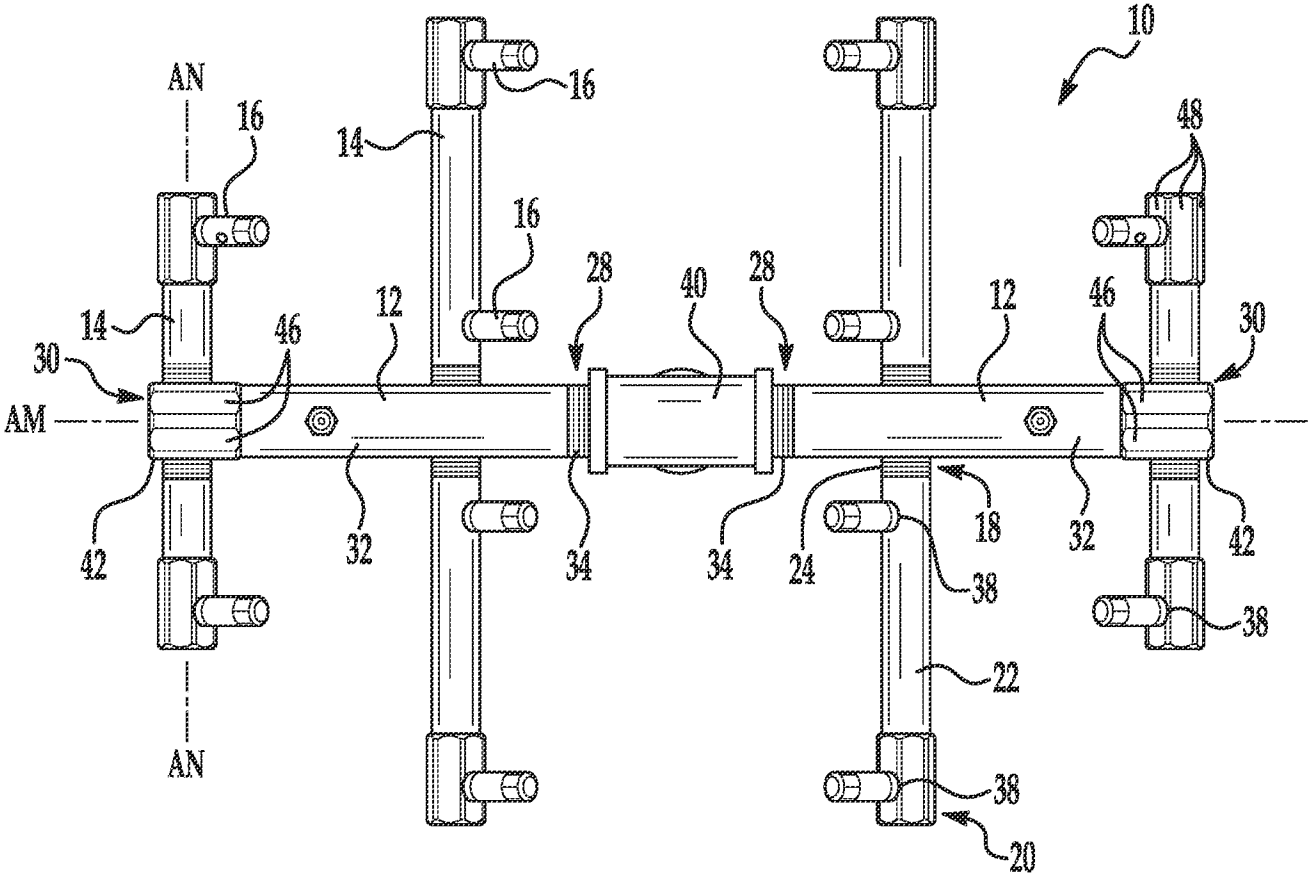
FIG. 2 is a top view of the decorative-flame burner of FIG. 1.
Figure 3:
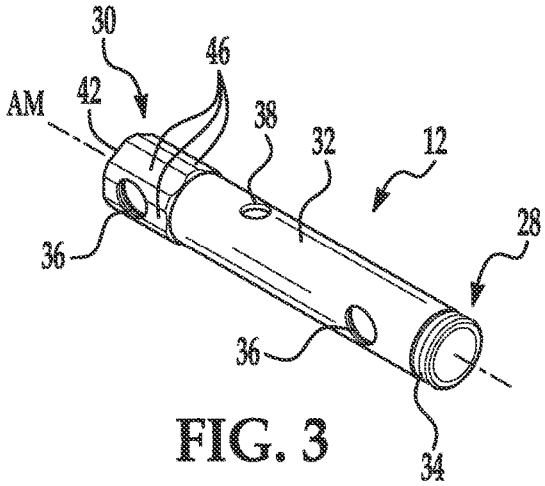
FIG. 3 is a perspective view of a manifold of the decorative-flame burner.
Figure 4:
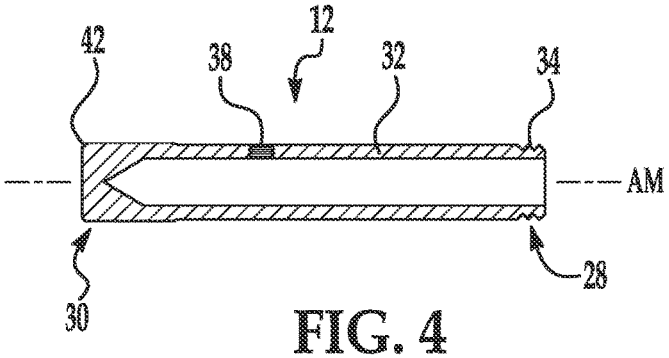
FIG. 4 is a cross-sectional view of the manifold.
Figure 5:
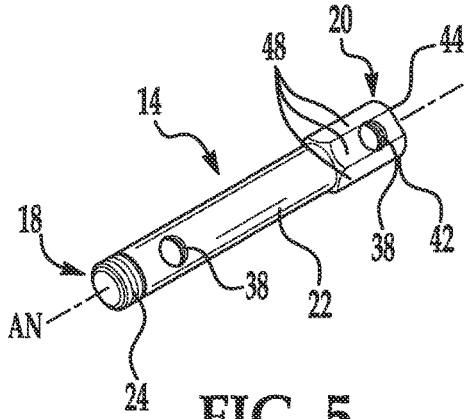
FIG. 5 is a perspective view of a nipple of the decorative-flame burner.
Figure 6:
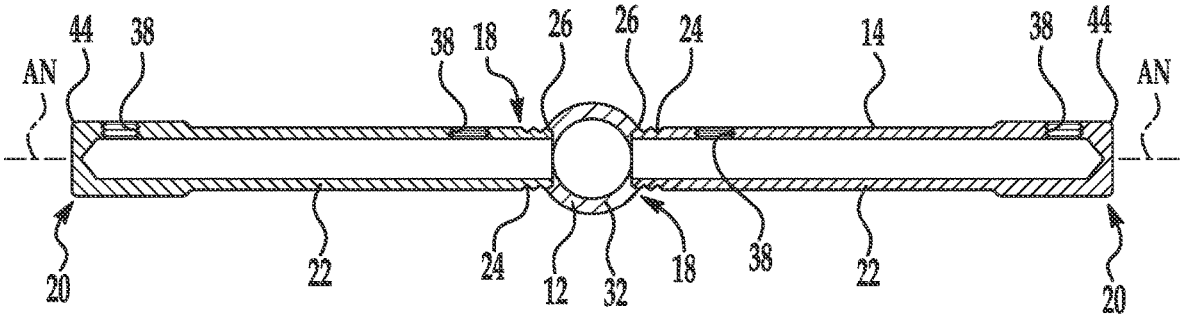
FIG. 6 is a cross sectional view of the decorative flame burner of FIG. 1.

With reference to FIGS. 1, 2, and 9, the burner 10 may include an inlet coupling 40. The manifold 12 is directly connected to the inlet coupling 40, i.e., with the lack of any intermediate component therebetween. For example, the inlet coupling 40 includes at least one threaded hole and the manifold 12 includes a thread 34 threadedly engaged with the threaded hole. In such an example, "directly connected" includes examples in which thread sealant is disposed between the manifold 12 and the inlet coupling 40. The manifold 12 is supported by the inlet coupling 40. Specifically, the manifold 12 is cantilevered from the inlet coupling 40.

In the example shown in FIGS. 1 and 2, the inlet coupling 40 is T-shaped. In the example shown in FIG. 9, the inlet coupling 40 is straight. In other examples including more than two manifolds 12, the inlet coupling 40 may include a corresponding number of threaded holes (i.e., one for each manifold 12) and may be of any suitable size and shape, as described further below.

The inlet coupling 40 is connected to a fuel supply source (not shown) to deliver fuel to the burner 10. In other words, the inlet coupling 40 may be a hub that feeds several manifolds 12 extending in different directions, e.g., as shown in the example in FIGS. 1 and 2. As described further below, in examples including more than one manifold 12, the manifolds 12 may be in a common plane and the inlet coupling 40 is designed accordingly.

The inlet coupling 40 may be a standard coupling as known in industry. As an example, the inlet coupling 40 may be ¾ inch NPT (National Pipe Thread), ½ inch NPT, or ⅜ inch NPT sized coupling available from any standard supplier. In such an example, the threaded holes of the inlet coupling 40 have ¾ inch NPT threads, ½ inch NPT threads, or ⅜ inch NPT threads and a standard corresponding sized and shaped body. In such an example, the manifold 12 includes threads 34 that match the threaded holes of the inlet coupling 40, e.g., ¾ NPT threads, ½ inch NPT threads, or ⅜ inch NPT threads.

Manifold(s) and Nipples

Each manifold 12 and each nipple 14 includes a first end 18, 28, a second end 20, 30, and a wall 22, 32 extending from the first end 18, 28 to the second end 20, 30. The first end 18, 28 is open and the second end 20, 30 is closed. In other words, the gas passageway extends through the first end 18, 28 and is plugged at the second end 20, 30. The gas passageway is elongated along the axis AM of the manifold 12. The gas passageways of the nipples 14 are in communication with the gas passageways of the manifolds 12, as described further below.

As shown in FIGS. 1-8, the first end 18, 28, the second end 20, 30, and the wall 22, 32 may be unitary, i.e., a single, continuous piece of material with no seams, joints, fasteners, welds, or adhesives holding it together. The manifold 12 may be formed as a unitary component and the nipple 14 may be formed as a unitary component, for example, by machining from a unitary blank, molding, forging, casting, etc. Non-unitary components, in contrast, are formed separately and subsequently assembled, e.g., by threaded engagement, welding, press-fitting, etc. In the example shown in FIGS. 1-8, each manifold 12 and each nipple 14 is formed by machining a brass bar, i.e., to include the gas passageway and the other features of the manifold 12 described herein. By being unitary, the manifold 12 may be assembled to the inlet coupling 40 by applying torque to the second end 30, which is transferred to the first end 28, without the potential for relative rotation between the first end 18 and the second end 20 of the nipple 14. Similarly, by being unitary, the nipple 14 may be assembled to the manifold 12 by applying torque to the second end 20, which is transferred to the first end 18, without the potential for relative rotation between the first end 18 and the second end 20 of the nipple 14. In the example shown in FIG. 9, the manifold 12 includes two non-unitary components, an elongated pipe and a threaded end cap that is threadedly engaged with the elongated pipe at the second end 30. Such a configuration can allow for customized length of the manifold 12. In such an example, the manifold 12 may be formed of red brass.

The manifolds 12 and the nipples 14 are annular in cross-section. In other words, the outer circumference and the inner circumference are circular. The outer circumference and the inner circumference of the wall 22, 32 may be constant from the first end 18, 28 to the second end 20, 30. In such an example, the manifolds 12 and the nipples 14 are generally tubular.

For each manifold 12, the manifold 12 may be straight from the first end 28 of the manifold 12 to the second end 30 of the manifold 12. Specifically, the axis AM of the manifold 12 may be straight. For each nipple 14, the nipple 14 may be straight from the first end 18 of the nipple 14 to the second end 20 of the nipple 14. Specifically, the axis AN of the nipple 14 may be straight. In examples in which the axes AM of the manifolds 12 and the axes AN of the nipples 14 are straight, the axes AM of the manifolds 12 are transverse to the axes AN of the nipples 14 to define the footprint of the burner 10 that, at least in part, generate the tall, dancing flame. In some examples, including those shown in the figures, the axes AM, AN may be perpendicular, which, at least in part, may generate the tall dancing flame.

The manifolds 12 have threads 34 at the first end 28 of the manifold 12 and a head 42 at the second end 30 of the manifold 12. The nipples 14 have threads 24 at the first end 18 of the nipple 14 and a head 44 at the second end 20 of the nipple 14. The threads 34 of the manifold 12 threadedly engage the inlet coupling 40. The threads 24 of the nipple 14 engage a respective threaded hole 36 of the manifold 12. The head 42 of the manifold 12 can be rotated to threadedly engage the threads 34 of the manifold 12 with the inlet coupling 40. The manifold 12 is supported by the inlet coupling 40 when threadedly engaged with the inlet coupling 40. The head 44 of the nipple 14 can be rotated to threadedly engage the threads 24 of the nipple 14 with the inlet manifold 12. The nipple 14 is supported by the manifold 12 when threadedly engaged with the manifold 12. As an alternative to the threaded engagement between the manifold 12 and the inlet coupling 40 and/or the threaded connection between the nipple 14 and the manifold 12, the components may be fixed together by, for example, press-fitting, brazing, and/or welding.

The head 42, 44 includes circumferential surfaces meeting at vertices spaced circumferentially about the axis AM, AN, i.e., the circumferential surfaces are angled relative to each other. The circumferential surfaces may be engaged by a tool to transfer torque from the tool to the manifold 12 for engaging the threads 34 with the inlet coupling 40. Specifically, the manifolds 12 and the nipples 14 may include flats 46, 48 at the second end 20, and specifically, at the head (i.e., the circumferential surfaces may be flats). The flats 46, 48 are planar. The flats 46, 48 each extend from one vertex to another vertex. The head 42, 44 may include six flats 46, 48 each meeting at the vertices, i.e., may be hexagonal, as shown in the examples in the Figures. As other examples, the head 42, 44 may include any suitable number of flats 46, 48 that may meet at vertices or may be separated by round surfaces. As an example, the head 46, 48 may include two flats parallel to each other and spaced from each other by two round surfaces therebetween.

The flats 42, 44 of the manifold 12 may extend from the wall 32 to a terminal tip of the manifold 12. The first end 28 of the manifold 12 may be defined as the portion of the manifold 12 including the threads 34 and the second end 30 of the manifold 12 may be defined as the portion of the manifold 12 including the vertices. In the examples in the Figures, the second end 30 of the manifold 12 is defined as the portion including the flats 46. Similarly, the flats of the nipple 14 may extend from the wall 22 to a terminal tip of the nipple 14. The first end 18 of the nipple 14 may be defined as the portion of the nipple 14 including the threads 24 and the second end 20 of the nipple 14 may be defined as the portion of the nipple 14 including the vertices. In the examples in the Figures, the second end of the nipple 14 is defined as the portion including the flats 48.

The manifold 12 is elongated along the axis AM. In other words, the longest dimension of the manifold 12 is along the axis AM of the manifold 12. In use, the axis AM may be horizontal. More than one nipple 14 is connected to the manifold 12. The manifold 12 delivers fuel from the inlet coupling 40 to the nipples 14.

The burner 10 may include any suitable number of manifolds 12, i.e., one or more. The example in FIG. 1 has two manifolds 12, the example in FIG. 9 has one manifold 12, and other examples may include three or more manifolds 12. In the example shown in FIG. 1, the burner 10 includes two manifolds 12 (i.e., a first manifold and a second manifold) each directly connected to the inlet coupling 40. Both manifolds 12 are coaxial, i.e., are elongated along a common axis. The manifolds 12 extend in opposite directions along the common axis from the inlet coupling 40. As set forth above, in examples including more than one manifold 12, the manifolds 12 may be elongated in a common plane. During operation of the burner 10, the common plane may be horizontal.

Each of a plurality of nipples 14 is directly connected to the manifold 12, i.e., with the lack of any intermediate component between the nipple 14 and the manifold 12. For example, the nipple 14 threadedly engages the manifold 12. Specifically, the manifold 12 has a plurality of threaded holes 36 each threadedly engaged with the threads 24 of the nipples 14. In such an example, "directly connected" includes examples in which thread sealant is disposed between the nipple 14 and the manifold 12. In examples including more than one manifold 12, each manifold 12 is directly connected to a plurality of nipples 14. For example, in the example shown in FIG. 1, one manifold 12 is directly connected to a plurality of nipples 14 and the other manifold 12 is directly connected to another plurality of nipples 14, i.e., a second plurality of nipples 14. The nipple 14 is supported by the manifold 12. Specifically, the nipple 14 is cantilevered from the manifold 12, as described further below.

The nipples 14 are elongated along the axis. In other words, the longest dimension of the nipple 14 is along the axis AN of the nipple 14. As set forth above, the axis AN of the nipple 14 may be straight.

The nipples 14 may be elongated in a common plane. Specifically, the nipples 14 and the manifolds 12 may be elongated on the common plane. As set forth above, during operation of the burner 10, the common plane may be horizontal.

The nipples 14 may extend from the manifold 12 perpendicular to the axis AM. For example, as set forth above, the axis AN of the nipples 14 may be straight and the axes AN of the nipples 14 may be perpendicular to the axes AM of the manifolds 12. Some of the nipples 14 may extend in a common direction from the manifold 12. Specifically, some of the nipples 14 on the manifold 12 may extend from the manifold 12 in one direction (i.e., a first common direction) perpendicular to the axis AM and/or some of the nipples 14 on the manifold 12 may extend in an opposite direction (i.e., a second common direction) perpendicular to the axis AM, i.e., 180 degrees apart around the circumference of the manifold 12.

The threaded holes 36 of the manifold 12 may be arranged in two lines along the axis AN, as shown in FIGS. 1 and 9. The lines may be on opposite sides of the manifold 12, i.e., arranged 180 degrees about the circumference of the manifold 12, as shown in the examples in FIGS. 1 and 9. The threaded holes 36 in each line are spaced from each other along the axis AM of the manifold 12. The threaded holes 36 on one line may be aligned along the axis AN with the threaded holes 36 of the other line, as shown in the example in FIG. 1. As another example, as shown in FIG. 9, the threaded holes 36 on one line may be spaced along the axis AN from the threaded holes 36 of the other line. Some may be aligned along the axis AM of the manifold 12 on opposite sides In examples in which at least one of the nipples 14 extends in one direction perpendicular to the axis AN and at least one of the nipples 14 extend in the opposite direction perpendicular to the axis AN, at least some of the nipples 14 extending in the one direction may be aligned along the axis AM of the manifold 12 with nipples 14 extending in the opposite direction. As another example, all of the nipples 14 extending in the one direction may be spaced along the axis AM of the manifold 12 from the nipples 14 extending in the opposite direction. In the example shown in FIG. 1, each nipple 14 extending in one direction is aligned along the axis AM of the manifold 12 with one nipple 14 extending in the opposite direction. In the example shown in FIG. 9, each nipple 14 extending in one direction is spaced along the axis AM of the manifold 12 from the nipples 14 extending in the opposite direction.

The nipples 14 may be spaced from each other along the axis AN to create the footprint of the burner 10 that provides, at least in part, the generation of the tall, dancing flame. For example, the nipples 14 have an outer diameter and the nipples 14 extending in a common direction may be spaced from each other along the axis AN by a distance at least four times the outer diameter with no nipples 14 therebetween. Specifically, the nipples 14 in the first common direction are spaced from each other along the axis AN by a distance at least four times the outer diameter with no nipples 14 extending in the first common direction therebetween. Likewise, the nipples 14 in the second common direction are spaced from each other along the axis AN by a distance at least four times the outer diameter with no nipples 14 extending in the second common direction therebetween.

The nipples 14 may be smaller in diameter than the manifold 12. Specifically, the manifold 12 has an outer diameter and each nipple 14 has an outer diameter smaller than the outer diameter of the manifold 12. In addition, the manifold 12 has an inner diameter and each nipple 14 has an inner diameter that may be smaller than the inner diameter of the manifold 12. The nipples 14 may each have the same inner diameter and outer diameter. In examples including more than one manifold 12, the manifolds 12 may each have the same inner diameter and the same outer diameter.

Each nipple 14 is supported by the manifold 12. The nipple 14 may be cantilevered from the manifold 12. The weight of the nipple 14 is supported by the manifold 12 at the first end 18 of the nipple 14 and the second end 20 of the nipple 14 is supported solely by the first end 18.

The lengths along the axes AM of each manifold 12 and the nipples 14 create the footprint of the burner 10 that provides, at least in part, the generation of the tall, dancing flame. As an example, the manifold 12 may be 4 to 6 inches long. The nipples 14 may have different lengths than each other, as shown in the examples in FIGS. 1 and 2. As another example, the manifold 12 may each have the same length, as shown in the example in FIG. 9. In the example in FIGS. 1 and 2, longer nipples 14 may be 3-5 inches long and shorter nipples 14 may be 2-3 inches long. In the example in FIG. 9, the nipples 14 may be 2-4 inches long.

The threads 34 of the manifold 12 may be ½-14 NPT threads and the manifold 12 may have other dimensions corresponding to that thread size such as outer diameter, inner diameter, and wall thickness. The threads 24 of the nipples 14 may be ¼-18 NPT threads and the nipples 14 may have other dimensions corresponding to that thread size such as outer dimeter, inner diameter, and wall thickness. As another example, the threads 34 of the manifold 12 may be ¾-14 NPT and the threads 24 of the nipples 14 may be ⅜-18 NPT.

As set forth above, the outer diameter of the nipple 14 may be smaller than the outer diameter of the manifold 12, and the inner diameter of the nipple 14 may be smaller than the inner diameter of the manifold 12. The outer diameter of the nipple 14 may be between 0.5-0.6 inches. For example, the outer diameter of the nipple 14 may be 0.54 inches. The inner diameter of the nipple 14 may be between 0.3-0.4 inches. For example, the inner diameter of the nipple 14 may be 0.375 inches. The wall thickness of the nipples 14 may be between 0.0675-0.0975 inches. The outer diameter of the manifold 12 may be between 0.8-0.9 inches. For example, the outer diameter of the manifold 12 may be 0.834 inches. The inner diameter of the manifold 12 may be between 0.55-0.65 inches. For example, the inner diameter of the manifold 12 may be 0.6 inches. The wall thickness of the manifold 12 may be between 0.102-0.132 inches. These dimensions, at least in part, provide suitable gas flow to generate the tall, dancing flame having yellow and/or orange color, and this outer diameter, inner diameter, and wall thickness advantageously minimizes the material, i.e., brass, of the nipple 14 and manifold 12 to reduce material cost in manufacturing.

Jets

Figure 7A:
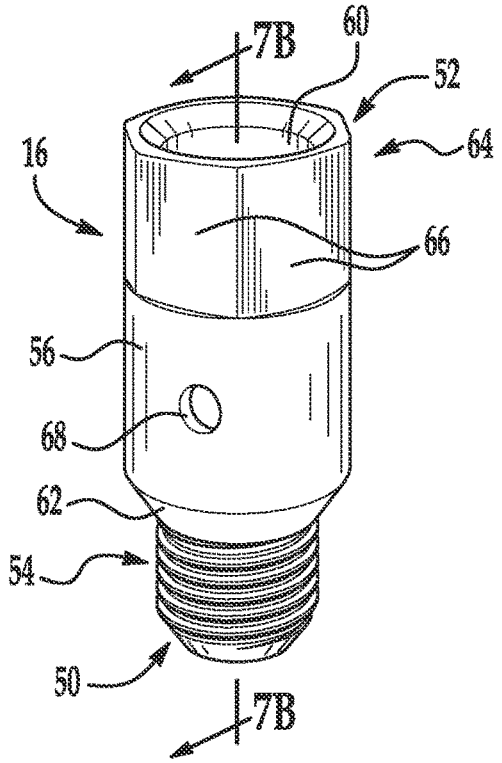
FIG. 7A is a perspective view of one example of a jet of the decorative-flame burner.
Figure 7B:
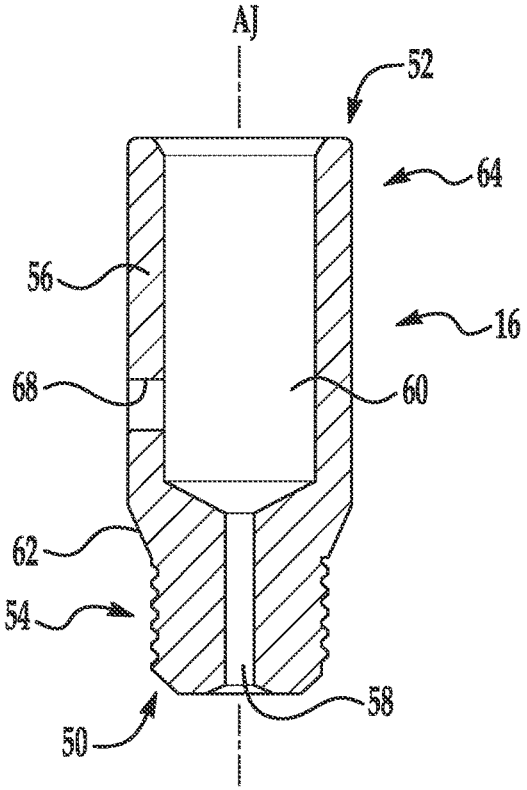
FIG. 7B is a cross-sectional view of the jet of FIG. 7A.
Figure 8A:
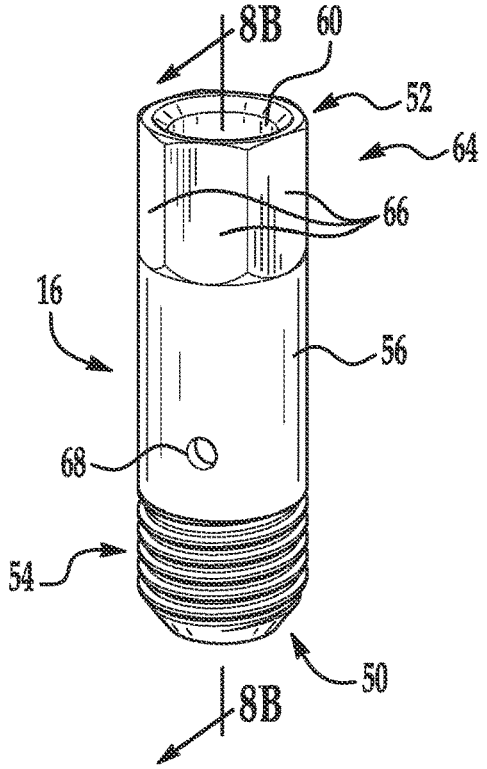
FIG. 8A is a perspective view of another example of a jet of the decorative-flame burner.
Figure 8B:
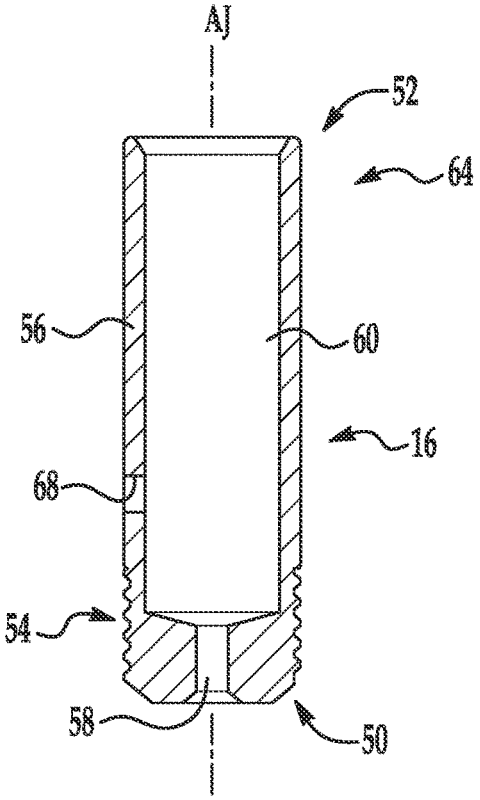
FIG. 8B is a cross-sectional view of the jet of FIG. 8A.

With reference to FIGS. 1 and 9, the burner 10 includes a plurality of jets 16. As set forth above, one example of the jet 16 is shown in FIGS. 7A-B and another example of the jet 16 is shown in FIGS. 8A-B.

The burner 10 may include any suitable number of jets 16 connected to the nipples 14. One or more jets 16 may also be connected to the manifold 12, as shown in FIG. 1. Each nipple 14 supports at least one jet 16. In the example shown in the Figures, some nipples 14 support one jet 16 and other nipples 14 support two jets 16. As other examples, each nipple 14 may support any suitable number of jets 16, i.e., one or more. In the example shown in FIGS. 1-2, each manifold 12 supports one jet 16. As other examples, each manifold 12 may support zero or any suitable number of jets 16.

Each jet 16 is connected to the respective nipple 14 or manifold 12. For example, each jet 16 is threadedly engaged with the respective nipple 14 or manifold 12. In other words, each jet 16 is formed separately from and subsequently attached to the respective nipple 14 or manifold 12.

The jet 16 protrudes outwardly from the respective nipple 14 or manifold 12. Each jet 16 is elongated along a longitudinal axis AJ. In other words, the longest dimension of the jet 16 is along the longitudinal axis of the jet 16. Each jet 16 includes a proximate end 50 and a fuel-combustion outlet 52 spaced from each other along the longitudinal axis AJ of the jet 16. The jet 16 is cantilevered from the nipple 14 or manifold 12, i.e., the fuel-combustion outlet 52 is supported only by the connection of the jet 16 to the respective nipple 14 or manifold 12. Each jet 16 may be straight from the proximate end 50 to the fuel-combustion outlet 52. Specifically, the longitudinal axis AJ of the jet 16 may be straight.

The jets 16 may be aimed in any suitable direction to generate the tall, dancing flame. The longitudinal axis of the jet 16 extends upwardly from the common plane at a non-right angle. Accordingly, the flame from all jets 16 combine into a single flame that is generally conical.

Each jet 16 includes a threaded portion 54 and a barrel 56. The threaded portion 54 and the barrel 56 are unitary, i.e., a single, continuous piece of material with no seams, joints, fasteners, welds, or adhesives holding it together. Each jet 16 may be formed as a unitary component, for example, by machining from a unitary blank, molding, forging, casting, etc. In the example shown in the Figures, each jet 16 is formed by machining a brass bar, e.g., to include the gas passageway and the other features of the jet 16 described herein.

The threaded portion 54 extends from the proximate end 50 toward the fuel-combustion outlet 52 along the longitudinal axis of the jet 16. The threaded portion 54 is threaded, and specifically, includes male threads. The threads of the threaded portion 54 may have any suitable size. The threads of the threaded portion 54 are the same size as the threads of threaded holes 38 of the nipples 14 and manifold 12.

The threads of the threaded portion 54 of the jet 16 may be, for example, 1/16-27 NPT threads. In such an example, the threaded portion 54 may have an outside diameter of 0.3125 inches. These dimensions of the threaded portion 54 encourage proper seating of the threaded portion 54 against the respective manifold 12 or nipple 14 of the dimensions described above (e.g., 0.54 inch outer diameter; 0.375 inch inner diameter; and 0.15-0.18 inch wall thickness of the nipple 14) when threadedly engaged with the threaded hole. As another example, the threads of the threaded portion 54 of the jet 16 may be 1/8-27 NPT. The jets 16 include an inlet bore 58 and a bore 60. The diameter of the inlet bore 58 may be between 0.02-0.08 inches. In one example, the diameter of the inlet bore 58 may be 0.022 inches. In another example, the diameter of the inlet bore 58 may be 0.062 inches.

The threaded portion 54 includes a length extending along the longitudinal axis AJ of the jet 16. The length extends from the proximate end 50 toward the fuel-combustion outlet 52. The threaded portion 54 may extend into the bore of the nipple 14 when the jet 16 is connected to the nipple 14, and into the bore of the manifold 12 when the jet 16 is connected to the manifold 12. The length of each jet 16 is between 0.9-1.1 inches. For example, the length of each jet 16 may be 1.0 inches. The length of the threaded portion 54 is between 0.2-0.3 inches. For example, the length may be 0.26 inches. This length minimizes the material usage in manufacturing the jet 16 while allowing for sufficient gas flow from the fuel-combustion outlet 52 to generate the tall, dancing flame having the yellow and/or orange color.

The jets 16 are in communication with the bores of the nipples 14 and the manifold 12. The inlet bore 58 of the jet 16 extends through the threaded portion 54 toward the fuel-combustion outlet 52 and the bore 60 extends from the inlet bore 58 through the fuel-combustion outlet 52. The inlet bore 58 and the bore 60 are open to each other. A diameter of the inlet bore 58 may be constant through the threaded portion 54. For example, the diameter of the inlet bore 58 may be constant from the proximate end 50 to the bore 60. The proximate end 50 may be chamfered at the inlet bore 58. The inlet bore 58 is in communication with the bores of the respective nipples 14 or manifold 12.

The barrel 56 extends from the fuel-combustion outlet 52 toward the threaded portion 54. As one example, the barrel 56 is spaced from the threaded portion 54, as shown in FIGS. 7A-B. In such an example, the jet 16 includes a tapering portion 62 between the barrel 56 and the threaded portion 54. The tapering portion 62 extends from the barrel 56 to the threaded portion 54. The tapering portion 62 includes an outer diameter that tapers from the barrel 56 to the threaded portion 54. That is, the outer diameter of the tapering portion 62 decreases along the longitudinal axis of the jet 16 from the barrel 56 to the threaded portion 54. The tapering portion 62 may have any suitable length along the longitudinal axis AJ of the jet 16. The tapering portion 62 may have any suitable full taper angle. As another example, as shown in FIGS. 8A-B, the barrel 56 extends to the threaded portion 54.

In the example shown in FIGS. 7A-B, the length of the barrel 56 is between 0.6-0.7 inches. For example, the length of the barrel 56 may be 0.64 inches. Additionally, the tapering portion 62 extends, e.g., 0.1 inches, from the barrel 56 to the threaded portion 54. Further, the tapering portion 62 may have a full taper angle of 60 degrees. In the example, shown in FIGS. 8A-B, the length of the barrel 56 is between 0.73-0.75 inches. For example, the length of the barrel 56 may be 0.74 inches.

The barrel 56 extends annularly about the longitudinal axis of the jet 16. The barrel 56 defines the bore 60 extending along the longitudinal axis AJ of the jet 16. A diameter of the bore 60, e.g., at the fuel-combustion outlet 52, is larger than the diameter of the inlet bore 58, as shown in FIGS. 7B and 8B. The diameter of the bore 60 may taper to the diameter of the inlet bore 58 at a countersink from the bore 60 to the inlet bore 58. The diameter of the bore 60 may be constant from the fuel-combustion outlet 52 to the countersink and the diameter of the inlet bore 58 may be constant from the countersink to the proximate end 50. The diameter of the bore 60 may be constant from the fuel-combustion outlet 52 to the tapering portion 62 and the diameter of the inlet bore 58 may be constant from the tapering portion 62 through the threaded portion 54.

The barrel 56 has an outer diameter, as set forth above. The outer diameter of the barrel 56 may be constant along the longitudinal axis of the jet 16. For example, as shown in FIGS. 7A-B, the outer diameter of the barrel 56 is constant from the fuel-combustion outlet 52 to the tapering portion 62. In such an example, the outer diameter of the barrel 56 is larger than an outer diameter of the threaded portion 54. As another example, as shown in FIGS. 8A-B, the outer diameter of the barrel 56 is constant from the fuel-combustion outlet 52 to the threaded portion 54. In such an example, the outer diameter of the barrel 56 is the same as the outer diameter of the threaded portion 54. The barrel 56 includes a wall thickness extending radially about the longitudinal axis AJ of the jet 16.

In the example shown in FIGS. 7A-B, the tapering portion 62 allows for proper seating of the threaded portion 54 against the respective manifold 12 or nipple 14; allows for sufficient gas flow to generate the tall, dancing flame having yellow and/or orange color; and provides robustness to resist breakage during installation and handling. Specifically, the tapering portion 62 provides material for sufficient wall thickness at the end of the bore 60, e.g., at the countersink.

For example, as described above, the end of the bore 60 is aligned along the longitudinal axis AJ of the jet 16 between the tapering portion 62 and the fuel-combustion outlet 52. Such a configuration provides a wall thickness suitable to withstand torque applied to the head 64 of the jet 16 during installation and handling.

In addition, with continued reference to FIGS. 7A-B, the outer diameter of the barrel 56 may be between 0.3-0.5 inches. For example, the outer diameter of the barrel 56 may be 0.4 inches. This outer diameter allows for suitable gas flow through the jet 16 to generate the tall, dancing flame having the yellow and/or orange color. Specifically, the diameter of the bore 60 at the fuel-combustion outlet 52 may be between 0.2-0.3 inches. For example, the diameter of the bore 60 at the fuel-combustion outlet 52 may be 0.25 inches. The wall thickness of the barrel 56 may be between 0.05-0.1 inches. For example, the wall thickness of the barrel 56 may be 0.075 inches.

With continued reference to FIG. 7B, the size of the diameter of the bore 60 may be between 75%-85% the size of the outer diameter of the threaded portion 54. In the example shown in FIG. 7B, the size of the diameter of the bore 60 is 80% the size of the outer diameter of the threaded portion 54. For example, as described above, the diameter of the bore 60 may be 0.25 inches and the outer diameter of the threaded portion 54 may be 0.3125 inches. This allows for sufficient gas flow from the fuel-combustion outlet 52 to generate the tall, dancing flame having the yellow and/or orange color and a proper seating of the threaded portion 54 against the respective nipple 14 or the manifold 12 while still being robust to resist breakage during installation and handling.

With continued reference to FIG. 7B, the wall thickness of the tapering portion 62 increases from the barrel 56 to the threaded portion 54. This increases the robustness of the jet 16 to resist breakage during installation and handling. The diverging angles of the countersink and the tapering portion 62 creates the increasing wall thickness from the barrel 56 to the threaded portion 54, as shown in FIG. 7B.

With reference to the example shown in FIGS. 8A-B, the jet 16 may have a constant outer diameter from the proximate end 50 to the fuel-combustion outlet 52. For example, the outer diameter of the jet 16 in FIGS. 8A-B may be 0.25-0.35 inches. As one example, the outer diameter of the jet 16 in FIGS. 8A-B may be 0.3125 inches.

The jet 16 includes a head 64 at the fuel-combustion outlet 52. The head 64 can be rotated to threadedly engage the threads 24 with the nipple 14 or the manifold 12. The head 64 has a width extending along the longitudinal axis of the jet 16, e.g., from the fuel-combustion outlet 52 toward the threaded portion 54. The width of the head 64 of the jet 16 is between 0.2-0.3 inches. For example, the width of the head 64 may be 0.25 inches.

The head 64 includes circumferential surfaces meeting at vertices spaced circumferentially about the longitudinal axis of the jet 16, i.e., the circumferential surfaces are angled relative to each other. The circumferential surfaces extend across the width of the head 64, i.e., the circumferential surfaces extend along the longitudinal axis of the jet 16.

The circumferential surfaces may be engaged by a tool to transfer torque from the tool to the jet 16 for engaging the threads of the threaded portion 54 with the nipple 14 or the manifold 12. Specifically, each jet 16 may include flats 66 at the head 64 (i.e., the circumferential surfaces may be flats 66). The flats 66 are planar. The flats 66 each extend from one vertex to another vertex. The head 64 may include six flats 66 each meeting at the vertices, i.e., may be hexagonal, as shown in the examples in the Figures. As other examples, the head 64 may include any suitable number of flats 66 that may meet at vertices or may be separated by round surfaces. As an example, the head 64 may include two flats parallel to each other and spaced from each other by two round surfaces therebetween.

With reference to FIG. 7B, the jet 16 is designed to resist breakage during installation (e.g., during application of torque to the head 64 of the jet 16 to tighten the threaded engagement of the jet 16 to the manifold 12 or nipple 14) and during handling (including potential dropping of the jet 16). As one example, the bore 60 terminates in the barrel 56. Specifically, the end of the bore 60 in the barrel 56, e.g., at the countersink, is aligned along the longitudinal axis of the jet 16 between the tapering portion 62 and the fuel-combustion outlet 52. Such a configuration provides a wall thickness suitable to withstand torque applied to the head 64 of the jet 16 during installation and handling. In examples including the countersink, the countersink terminates at one end aligned along the longitudinal axis AJ of the jet 16 with the barrel 56 and terminates at another end aligned along the longitudinal axis of the jet 16 with the tapering portion 62. The inlet bore 58 terminates at an end aligned along the longitudinal axis AJ of the jet 16 with the tapering portion 62. The countersink between the bore 60 and the inlet bore 58 provides sufficient wall thickness for installation and handling of the jet 16.

Each jet 16 has a length along the longitudinal axis AJ of the jet 16. The length extends from the proximate end 50 to the fuel-combustion outlet 52 of the jet 16. The jets 16 may have any suitable length. For example, each jet 16 may have the same length.

The barrel 56 has a length along the longitudinal axis of the jet 16. The length of the barrel 56 extends from the fuel-combustion outlet 52 toward the threaded portion 54. As shown in FIGS. 7A-B, the length of the barrel 56 extends from the fuel-combustion outlet 52 to the tapering portion 62. As shown in FIGS. 8A-B, the length of the barrel 56 extends from the fuel-combustion outlet 52 to the threaded portion 54. The barrel 56 may have any suitable length.

The barrel 56 includes at least one oxygen hole 68 extending through the barrel 56 to the bore 60 of the jet 16. For example, the barrel 56 includes one oxygen hole 68 when the fuel is natural gas, as shown in FIGS. 7A-8B. As another example, the barrel 56 includes two oxygen holes 68 when the fuel is propane. In such an example, the two oxygen holes 68 may be spaced diametrically from each other.

The oxygen hole 68 may be disposed at any suitable position along the barrel 56. That is, the oxygen hole 68 may be disposed between the threaded portion 54 and the fuel-combustion outlet 52. For example, the oxygen hole 68 may be disposed between the threaded portion 54 and the head 64 of the barrel 56. As another example, the oxygen hole 68 may be disposed on the head 64 of the barrel 56. In such an example, the oxygen hole 68 may extend through one flat 64 of the head 64. The oxygen hole 68 includes a diameter. The position and the diameter of the oxygen hole 68 may be selected to achieve the yellow and/or orange flame.

The diameter of the oxygen hole 68 may be between 0.02-0.1 inches. For example, the diameter of the oxygen hole 68 may be 0.086 inches. This diameter of the oxygen hole 68 provides quiet operation of the burner 10.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A burner comprising:

a manifold elongated along an axis;

a plurality of nipples supported by the manifold; and a jet supported by and protruding outwardly from each nipple, each jet including a fuel-combustion outlet;

the manifold including a first end that is open, a second end that is closed, and a wall extending from the first end to the second end;

each nipple having a first end that is open, a second end that is closed, and a wall extending from the first end of the nipple to the second end of the nipple;

each nipple being elongated transverse to the axis at the first end of the nipple;

the manifold having an inner diameter and each nipple having an inner diameter at the manifold that is smaller than the inner diameter of the manifold at the respective nipple;

each nipple having an outer diameter at the manifold that is smaller than the inner diameter of the manifold; and each jet having an inner diameter at the respective nipple that is smaller than the inner diameter of the respective nipple at the respective jet.

2. The burner as set forth in claim 1, wherein, for each jet, the inner diameter of the jet expands from the respective nipple to the respective fuel-combustion outlet.

3. The burner as set forth in claim 1, wherein each jet has threads threadedly engaged with the respective nipple.

4. The burner as set forth in claim 1, wherein each jet has an outer diameter at the respective nipple that is smaller than the inner diameter of the respective nipple at the respective jet.

5. The burner as set forth in claim 1, wherein each jet is elongated from the nipple to the fuel-combustion opening.

6. The burner as set forth in claim 1, wherein the jets each have an annular cross-section.

7. The burner as set forth in claim 1, wherein the first end of the manifold, the second end of the manifold, and the wall of the manifold are unitary.

8. The burner as set forth in claim 1, wherein the manifold is straight from the first end of the manifold to the second end of the manifold.

9. The burner as set forth in claim 1, wherein the manifold has an outer diameter and the outer diameter of the nipple at the manifold is smaller than the outer diameter of the manifold at the respective nipple.

10. The burner as set forth in claim 1, wherein the inner diameter of the manifold is between 0.59-0.61 inches.

11. The burner as set forth in claim 1, wherein the inner diameter of the manifold is constant from the first end of the manifold to the second end of the manifold.

12. The burner as set forth in claim 11, wherein, for each nipple, the inner diameter of the nipple is constant from the first end of the nipple to the second end of the nipple.

13. The burner as set forth in claim 12, wherein, for each jet, the inner diameter of the jet expands from the respective nipple to the respective fuel-combustion outlet.

14. The burner as set forth in claim 1, wherein each nipple has threads at the first end of the nipple, and the manifold includes threaded holes threadedly engaged with the threads on the first ends of the nipples.

15. The burner as set forth in claim 14, wherein the first end of the nipple, the second end of the nipple, and the wall of the nipple are unitary.

16. The burner as set forth in claim 15, wherein each nipple has flats at the second end of the nipple, the flats being arranged circumferentially about the second end of the nipple.

17. The burner as set forth in claim 14, wherein at least some of the threaded holes of the manifold are spaced from each other along the axis and at least some of the threaded holes of the manifold are aligned with each other along the axis.

18. The burner as set forth in claim 14, wherein the nipple has an outer diameter of 0.54 inches and the threads of the nipple taper and have a pitch of 18 threads per inch.

19. The burner as set forth in claim 1, wherein the first end of the nipple, the second end of the nipple, and the wall of the nipple are unitary.

20. The burner as set forth in claim 1, wherein all of the nipples are in a common plane.

21. The burner as set forth in claim 1, wherein at least one nipple extends in one direction perpendicular to the axis and at least one nipple extends in an opposite direction perpendicular to the axis.

22. The burner as set forth in claim 1, wherein the manifold is annular in cross-section and the nipples are annular in cross-section.

* * * * *